US005368454A

United States Patent [19]

Powers

[11] Patent Number: 5,368,454

[45] Date of Patent: Nov. 29, 1994

[54] QUIET CHECK VALVE

[75] Inventor: Frederick A. Powers, Maple Grove, Minn.

[73] Assignee: Graco Inc., Minneapolis, Minn.

[21] Appl. No.: 923,342

[22] Filed: Jul. 31, 1992

[51] Int. Cl.[5] ..... F04B 21/02

[52] U.S. Cl. ..... 417/536; 137/533.11

[58] Field of Search ..... 417/536, 404; 137/533.11, 533.13

[56] References Cited

U.S. PATENT DOCUMENTS

| | | | |
|---|---|---|---|
| 1,380,415 | 6/1921 | Putnam | 137/533.11 |
| 1,867,585 | 7/1932 | Moore | 417/536 |
| 2,899,974 | 8/1959 | Gratzmuller | 137/533.11 |
| 4,601,305 | 7/1986 | Nordskog | 137/533.11 X |
| 4,633,681 | 1/1987 | Webber | 137/533.11 X |
| 4,775,303 | 10/1988 | Liska | 417/554 |

FOREIGN PATENT DOCUMENTS

| | | | |
|---|---|---|---|
| 2480394 | 10/1981 | France | 137/533.11 |
| 439523 | 9/1948 | Italy | 417/536 |

OTHER PUBLICATIONS

"The High-Flo$^R$ series of Pumps", Instructions-Parts List, Copyright 1984 Graco, Inc. Form No. 307-678, General Information.

*Primary Examiner*—Richard E. Gluck
*Attorney, Agent, or Firm*—Douglas B. Farrow

[57] ABSTRACT

This invention represents an improvement in a standard four ball reciprocating piston pump. Such pumps utilize a greatly enlarged seat to provide hydraulic cushioning of the check balls in order to greatly quiet operation. A seat width on the order of 6% of the ball's circumference is preferred. Closely confining the ball to the axis of the seat helps efficient and quiet operation.

3 Claims, 2 Drawing Sheets

QUIET CHECK VALVE

BACKGROUND OF THE INVENTION

Reciprocating piston pumps of the four ball variety have been known and used in industry for a number of years, particularly in automotive applications to pump paint in circulating systems. As noise regulations have become increasingly stringent in recent years, various proposals have been made to quiet the air motors which drive such pumps and great progress has been made in this area.

Once, however, the original source of noise (the air motor) was quieted, another source of noise became glaringly apparent, that of the steel check balls. The noise from these check balls alone can be on the order of 88 to 89 dbA.

SUMMARY OF THE INVENTION

It is therefore, an object of this invention to produce a four ball reciprocating piston pump which has much quieter ball checks than those currently available, and which may be easily and inexpensively manufactured.

The instant invention accomplishes these goals by providing a relatively wide seat (10 mm compared to previous typical seat widths with 2 mm) in conjunction with a 159 mm circumference ball. By utilizing this wide seat, a hydraulic cushion helps soften the final seating of the ball and preventing the hard contact which produced the large amount of noise known in currently available products.

In conjunction with this wide seat, a closely fitted ball guide and retainer insures that the ball remains essentially on axis with the seat. Prior art devices allowed the ball a wide amount of latitude and typically would allow 1.5 mm of radial clearance while the guide of the instant invention provides a radial clearance of about 0.2 mm.

Utilizing such designs results in a greatly reduced noise level on the order of 74 dbA or net reduction of 14 to 15 dbA.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
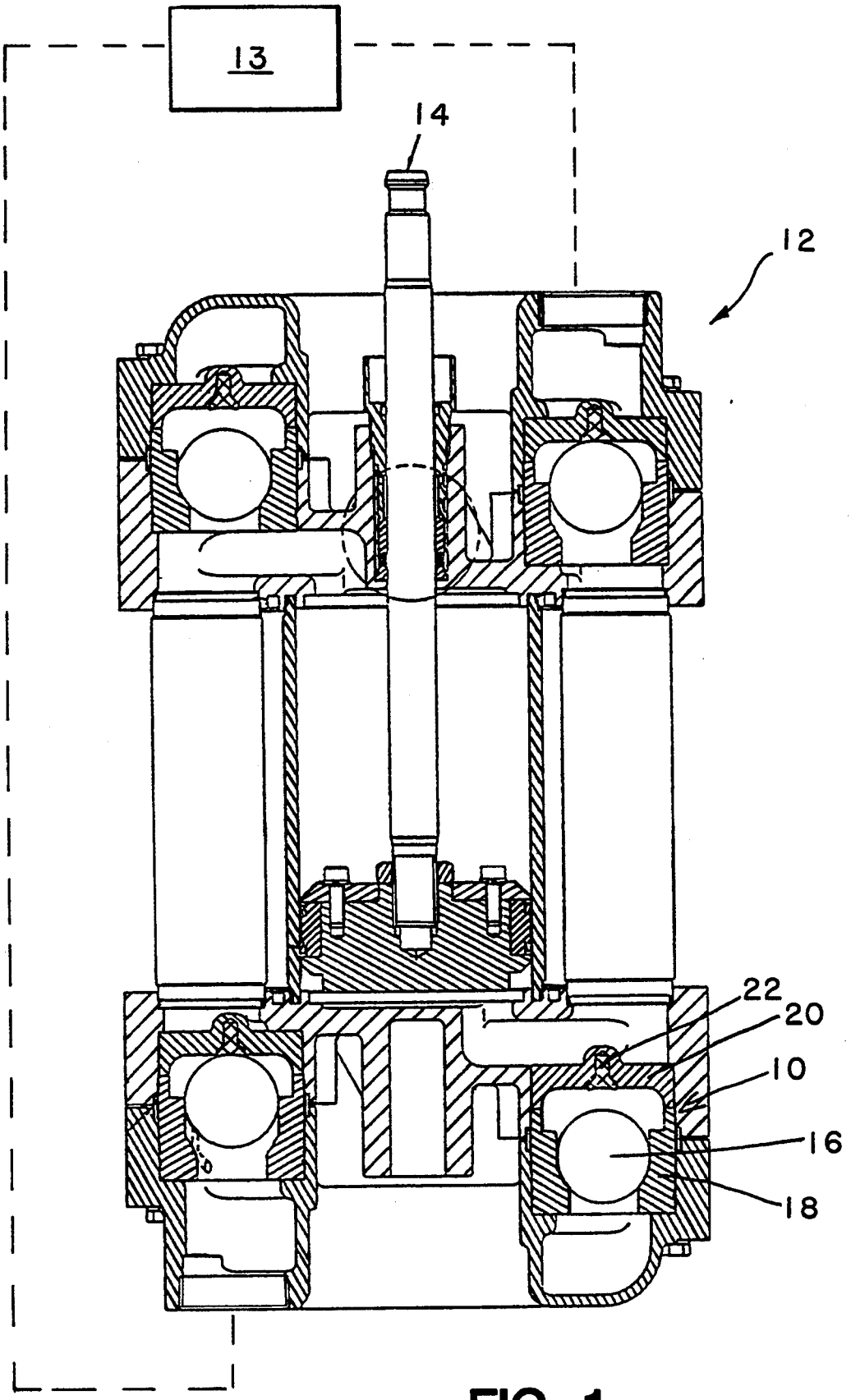
FIG. 1 is a cross-sectional view showing a four ball pump utilizing the instant invention.

The check valve assembly 10 of the instant invention is utilized in a four ball reciprocating piston pump 12 as shown in FIG. 1. Such pumps 12 are typically driven via input shaft 14 which is in turn attached to a reciprocating air motor, such air motors being generally well known. Pump 12 is typically utilized in an automotive plant for circulating paint to spraying stations by connection to a paint circulating system 13.

Ball check assemblies 10 are generally comprised of a ball 16, a seat assembly 18 and a retainer 20 having a retainer button 22 located therein. Button 22 is made of plastic and helps restrain the ball at its upper limits of travel shown in the lower left side of FIG. 1.

Figure 3:
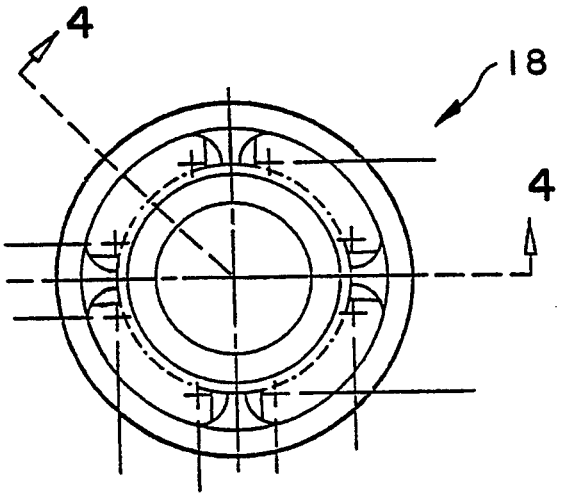
FIG. 3 is a view looking downwardly on the ball guide and seat of the instant invention.
Figure 2:
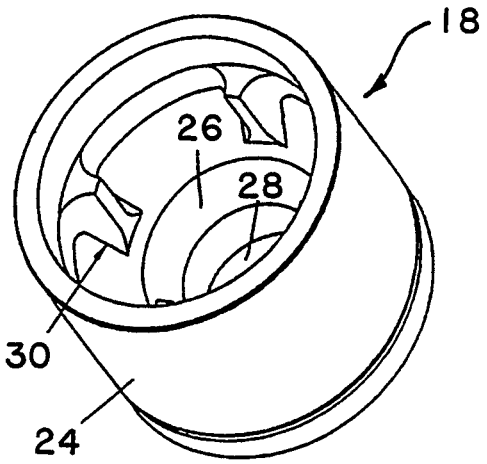
FIG. 2 is a perspective view showing the ball guide and seat of the instant invention.

Returning to FIGS. 2 through 4, seat assembly 18 can be seen in more detail. In particular, assembly 18 has an outer housing 24, a seat 26, an outlet passage 28 and four spacing fingers which extend inwardly. Of course, more or less than four fingers may be utilized.

Figure 4:
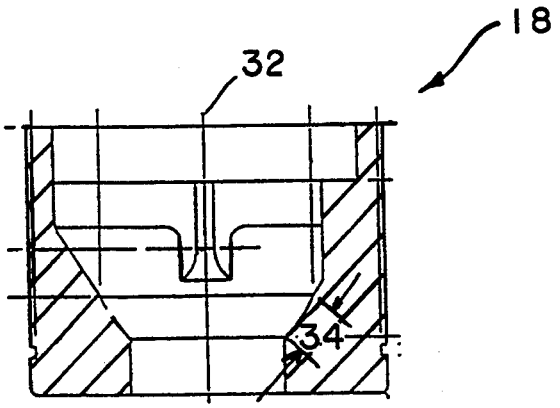
FIG. 4 is a sectional view taken along line 4—4 of FIG. 3.

Axis 32 is shown particularly in FIG. 4 and clearance is provided between fingers 30 and ball 16 on the order of 0.2 mm per side (in other words, radial clearance), which generally keeps the ball directly over seat 26. Seat 26 has a width of 34 as shown in FIG. 4 of approximately 10 mm.

What is claimed is:

1. In a pump connected to a source of coating material and having inlet and outlet passages and at least one ball check located in one of said passages, said ball check comprising a ball having a circumference and a seat having a width, the improvement wherein said seat width is at least about 6% of said ball circumference and further comprising a ball retainer located above said seat wherein said seat has an axis and said ball retainer confines the center of said ball within about 0.25 mm of said axis.

2. The pump of claim 1 wherein said pump is a reciprocating piston pump.

3. The pump of claim 1 wherein said pump is a four ball pump.

* * * * *